US005300250A

United States Patent [19]

Morgan et al.

[11] Patent Number: 5,300,250

[45] Date of Patent: Apr. 5, 1994

[54] GRANULAR LAUNDRY COMPOSITIONS HAVING IMPROVED SOLUBILITY

[75] Inventors: Ronald D. Morgan, Cincinnati, Ohio; Gary R. Cutter, Dillsboro, Ind.

[73] Assignee: The Procter & Gamble Company, Cincinnati, Ohio

[21] Appl. No.: 974,001

[22] Filed: Nov. 20, 1992

Related U.S. Application Data

[63] Continuation-in-part of Ser. No. 820,184, Jan. 14, 1992, abandoned.

[51] Int. Cl.[5] ..... C11D 3/08; C11D 3/10

[52] U.S. Cl. ..... 252/135; 252/174.14; 252/385

[58] Field of Search ..... 252/135, 174.14, 174.13, 252/382, 385

[56] References Cited

U.S. PATENT DOCUMENTS

| | | | |
|---|---|---|---|
| 2,381,960 | 8/1945 | Johnson | 210/697 |
| 3,361,675 | 1/1968 | Fuchs et al. | 252/99 |
| 4,299,717 | 11/1981 | Cottrell et al. | 252/99 |
| 4,303,557 | 12/1981 | Rose | 252/527 |
| 4,344,871 | 8/1982 | Allaway et al. | 252/531 |
| 4,686,062 | 8/1987 | Kermode et al | 252/99 |
| 4,783,281 | 11/1988 | Bishop et al. | 252/135 |
| 4,832,863 | 5/1989 | Trabitzsch et al. | 252/135 |
| 4,999,138 | 3/1991 | Nebashi et al. | 252/543 |

FOREIGN PATENT DOCUMENTS

| | | |
|---|---|---|
| 0256679 | 2/1988 | European Pat. Off. . |
| 0456315A2 | 11/1991 | European Pat. Off. . |
| 61-164000 | 7/1986 | Japan . |
| 62-228000 | 10/1987 | Japan . |
| 2005715 | 4/1979 | United Kingdom . |
| 2233338 | 9/1991 | United Kingdom . |

OTHER PUBLICATIONS

Chemical Principles, 4th Ed., Masterton Slowinski, W. B. Saunders Co. 1977, p. 43.

Dequssa Technical Bulletin Pigments No. 11, issued Oct. 1982.

Dequssa Technical Bulletin Pigments No. 6, issued Oct. 1986.

Dequssa Technical Bulletin Pigments No. 32, issued Oct. 1980.

Dequssa Technical Bulletin Pigments No. 76, issued Oct. 1988.

Dequssa Technical Bulletin Pigments No. 64, issued Oct. 1984.

Dequssa Technical Bulletin Pigments No. 31, issued Oct. 1984.

Dequssa Technical Bulletin Pigments No. 28, issued Oct. 1983.

Dequssa Bulletin, Precipitated Silicas and Silicates issued Jul. 1984.

Dequssa Bulletin, Aerosil Fumed Silica (year unknown).

Dequssa Bulletin, Fumed Silicas, Precipitated Silicas (year unknown).

Dequssa Product Information, Dequssa Silicas for the Food Industry, dated 1990.

Dequssa Product Information, Improvement of the Wettability and Dispersibility of Powdered Food and Feed Products (year unknown).

Dequssa Product Information, Dequssa Silicas as Free Flow and Conditioning Agents for the Food Industry, dated Jul. 1988.

Dequssa Bulletin, Fumed Silicas, Precipitated Silicas (year unknown).

Dequssa Product Information, Dequssa Silicas for the Food Industry, dated 1990.

*Primary Examiner*—Asok Pal

*Assistant Examiner*—Achutamurthy

*Attorney, Agent, or Firm*—Fernando A. Borrego; Donald E. Hasse; Jacobus C. Rasser

[57] ABSTRACT

Granular laundry detergent, bleach or additive compositions containing admixed sodium carbonate and low levels of admixed hydrophobic amorphous silicate material to improve solubility. The compositions preferably contain aluminosilicate detergent builders and preferably are free of phosphate builders. Also disclosed are processes for improving solubility of such granular laundry compositions.

13 Claims, No Drawings

GRANULAR LAUNDRY COMPOSITIONS HAVING IMPROVED SOLUBILITY

REFERENCE TO RELATED APPLICATION

This application is a continuation-in-part of U.S. patent application Ser. No. 820,184, filed Jan. 14, 1992, now abandoned.

FIELD OF THE INVENTION

The present invention relates to granular laundry detergent, bleach or additive compositions containing admixed sodium carbonate which have improved solubility in the laundering solution. More particularly, it relates to the addition of low levels of admixed hydrophobic amorphous silicate material to such granular laundry compositions to improve their solubility under washing conditions which inhibit dissolution in water. Processes for improving solubility of granular laundry compositions containing admixed sodium carbonate by adding hydrophobic amorphous silicate material in selected ratios are also included.

BACKGROUND OF THE INVENTION

Granular laundry detergents containing admixed sodium carbonate have been found to exhibit poor solubility under certain conditions. This can result in clumps of detergent, which appear as solid white masses ranging from about 5 to 40 millimeters in diameter and about 2 to 10 millimeters in length, remaining in the washing machine and on washed clothes. Such clumps usually occur when the detergent is placed in a pile in the washing machine, particularly during cold water washes and/or when the order of addition to the washing machine is laundry detergent first, clothes second, and water last. It has been found that the primary contributor to this solubility problem is the admixed sodium carbonate in the laundry detergent. While not intending to be limited by theory, it is believed that this solubility problem is caused by hydration of the sodium carbonate, which results in a sticky, poorly soluble mass, before the granular detergent can be dispersed and solubilized in the laundering solution. Surprisingly, granular detergents containing sodium carbonate as part of a spray dried base granule usually do not exhibit this solubility problem, apparently because the carbonate is uniformly dispersed in a matrix of more soluble ingredients. Granular detergents also generally have poorer solubility if they contain sodium pyrophosphate builder.

Sodium carbonate and sodium pyrophosphate have been used in granular detergent compositions (for example, U.S. Pat. No. 4,299,717, Cottrell et al, issued Nov. 10, 1981). Potassium salt has been substituted for sodium salt to eliminate giant micelles of sodium salt of washed fatty acid in the washing liquid (Japanese Patent Application 61164000). The solubility of a solid is lower in a solution of a salt containing a common ion than in pure water (*Chemical Principles*, 4th ed., Masterton Slowinski, W. B. Saunders Co. 1977, pg. 435). A water-softening composition comprising tetrasodium pyrophosphate and an alkaline material selected from the group consisting of trisodium phosphate, sodium hydroxide, sodium carbonates, potassium hydroxide, potassium carbonates, soap and sodium silicate is disclosed in U.S. Pat. No. 2,381,960, Johnson, issued Aug. 14, 1945.

It has now been discovered that the addition of low levels of hydrophobic amorphous silicate material to granular laundry detergents, bleaches or additives containing admixed sodium carbonate improves their solubility in the laundering solution and eliminates or reduces the problem of clumps remaining in the washing machine and on washed clothes. While not intending to be limited by theory, it is believed that the hydrophobic amorphous silicate material inhibits crystal growth of hydrated sodium carbonate by physically separating and/or coating individual carbonate particles before dissolution begins. This enhances dispersion and solubilization of the granular composition and minimizes the formation of insoluble clumps.

SUMMARY OF THE INVENTION

The invention encompasses a granular laundry detergent, bleach or additive composition comprising, by weight:

(a) from 0 to 70% detergent surfactant selected from the group consisting of anionics, nonionics, zwitterionics, ampholytics, cationics, and mixtures thereof;

(b) from about 5 to 99.95% of admixed sodium carbonate; and (c) from about 0.05% to 5% of admixed hydrophobic amorphous silicate material;

wherein the weight ratio of (b):(c) is from about 5:1 to about 500:1.

A process for improving solubility of such granular laundry compositions containing admixed sodium carbonate by adding hydrophobic amorphous silicate material is also included.

DESCRIPTION OF THE INVENTION

This invention relates to a granular laundry detergent, bleach or additive composition containing admixed sodium carbonate and hydrophobic amorphous silicate material. The composition is soluble in cold or cool water, i.e. the composition readily dissolves/disperses in water at a temperature between about 32° F. (0° C.) and 90° F. (32.2° C.), preferably between about 35° F. (1.6° C.) and 50° F. (10° C.). Because of the incorporation of the hydrophobic amorphous silicate material, no significant amount of product remains bound in the clothes or in the bottom of the washing machine tub after a typical cold water wash cycle, even with a "reverse" order of addition to the washing machine, i.e., product first, clothes second, water last. The hydrophobic amorphous silicate material also acts as an anti-caking agent and flow aid, which improves physical properties and handling characteristics of the present compositions and increases density.

The granular compositions of the present invention contain admixed sodium carbonate and hydrophobic amorphous silicate material, and preferably a detergent surfactant. These and optional ingredients, and processes for making the compositions and improving the solubility of such compositions, are described in detail hereinafter.

A. Detergent Surfactant

The compositions of the present invention comprise from 0 to 70 weight % of a detergent surfactant selected from the group consisting of anionics, nonionics, zwitterionics, ampholytics, cationics, and mixtures thereof. Preferably the surfactant represents from about 5 to 50%, most preferably from about 10 to 25%, by weight of the composition and is selected from the group consisting of anionics, nonionics, and mixtures thereof.

Water-soluble salts of the higher fatty acids, i.e., "soaps", are useful anionic surfactants in the compositions herein. This includes alkali metal soaps such as the sodium, potassium, ammonium, and alkyl ammonium salts of higher fatty acids containing from about 8 to about 24 carbon atoms, and preferably from about 12 to about 18 carbon atoms. Soaps can be made by direct saponification of fats and oils or by the neutralization of free fatty acids. Particularly useful are the sodium and potassium salts of the mixtures of fatty acids derived from coconut oil and tallow, i.e., sodium or potassium tallow and coconut soap.

Useful anionic surfactants also include the water-soluble salts, preferably the alkali metal, ammonium and alkylolammonium salts, of organic sulfuric reaction products having in their molecular structure an alkyl group containing from about 10 to about 20 carbon atoms and a sulfonic acid or sulfuric acid ester group. (Included in the term "alkyl" is the alkyl portion of acyl groups.) Examples of this group of synthetic surfactants are the sodium and potassium alkyl sulfates, especially those obtained by sulfating the higher alcohols ($C_{12}$–$C_{18}$ carbon atoms) such as those produced by reducing the glycerides of tallow or coconut oil ; and the sodium and potassium alkylbenzene sulfonates in which the alkyl group contains from about 10 to about 16 carbon atoms, in straight chain or branched chain configuration, e.g., see U.S. Pat. Nos. 2,220,099 and 2,477,383. Especially valuable are linear straight chain alkylbenzene sulfonates in which the average number of carbon atoms in the alkyl group is from about 11 to 14, abbreviated as $C_{11-14}$ LAS.

Especially preferred are mixtures Of $C_{10-16}$ (preferably $C_{11-13}$) linear alkylbenzene sulfonates and $C_{12-18}$ (preferably $C_{14-16}$) alkyl sulfates. These are preferably present in a weight ratio of between 4:1 and 1:4, preferably about 3:1 to 1:3, alkylbenzene sulfonate: alkyl sulfate. Sodium salts of the above are preferred.

Other anionic surfactants herein are the sodium alkyl glyceryl ether sulfonates, especially those ethers of higher alcohols derived from tallow and coconut oil; sodium coconut oil fatty acid monoglyceride sulfonates and sulfates; sodium or potassium salts of alkyl phenol ethylene oxide ether sulfates containing from about 1 to about 10 units of ethylene oxide per molecule and wherein the alkyl groups contain from about 8 to about 12 carbon atoms; and sodium or potassium salts of alkyl ethylene oxide ether sulfates containing about 1 to about 10 units of ethylene oxide per molecule and wherein the alkyl group contains from about 10 to about 20 carbon atoms.

Other useful anionic surfactants herein include the water-soluble salts of esters of alpha-sulfonated fatty acids containing from about 6 to 20 carbon atoms in the fatty acid group and from about 1 to 10 carbon atoms in the ester group; water-soluble salts of 2-acyloxyalkane-1-sulfonic acids containing from about 2 to 9 carbon atoms in the acyl group and from about 9 to about 23 carbon atoms in the alkane moiety; water-soluble salts of olefin and paraffin sulfonates containing from about 12 to 20 carbon atoms; and beta-alkyloxy alkane sulfonates containing from about 1 to 3 carbon atoms in the alkyl group and from about 8 to 20 carbon atoms in the alkane moiety.

Water-soluble nonionic surfactants are also useful in the instant detergent granules. Such nonionic materials include compounds produced by the condensation of alkylene oxide groups (hydrophilic in nature) with an organic hydrophobic compound, which may be aliphatic or alkyl aromatic in nature. The length of the polyoxyalkylene group which is condensed with any particular hydrophobic group can be readily adjusted to yield a water-soluble compound having the desired degree of balance between hydrophilic and hydrophobic elements.

Suitable nonionic surfactants include the polyethylene oxide condensates of alkyl phenols, e.g., the condensation products of alkyl phenols having an alkyl group containing from about 6 to 15 carbon atoms, in either a straight chain or branched chain configuration, with from about 3 to 80 moles of ethylene oxide per mole of alkyl phenol.

Included are the water-soluble and water-dispersible condensation products of aliphatic alcohols containing from 8 to 22 carbon atoms, in either straight chain or branched configuration, with from 3 to 12 moles of ethylene oxide per mole of alcohol.

Semi-polar nonionic surfactants include water-soluble amine oxides containing one alkyl moiety of from abut 10 to 18 carbon atoms and two moieties selected from the group of alkyl and hydroxyalkyl moieties of from about I to about 3 carbon atoms; water-soluble phosphine oxides containing one alkyl moiety of about 10 to 18 carbon atoms and two moieties selected from the group consisting of alkyl groups and hydroxyalkyl groups containing from about 1 to 3 carbon atoms; and water-soluble sulfoxides containing one alkyl moiety of from about 10 to 18 carbon atoms and a moiety selected from the group consisting of alkyl and hydroxyalkyl moieties of from about 1 to 3 carbon atoms.

Preferred nonionic surfactants are of the formula $R^1(OC_2H_4)_nOH$, wherein $R^1$ is a $C_{10}$–$C_{16}$ alkyl group or a $C_8$–$C_{12}$ alkyl phenyl group, and n is from 3 to about 80.

Particularly preferred are condensation products Of $C_{12}$–$C_{15}$ alcohols with from about 5 to about 20 moles of ethylene oxide per mole of alcohol, e.g., $C_{12}$–$C_{13}$ alcohol condensed with about 6.5 moles of ethylene oxide per mole of alcohol.

Ampholytic surfactants include derivatives of aliphatic or aliphatic derivatives of heterocyclic secondary and tertiary amines in which the aliphatic moiety can be straight chain or branched and wherein one of the aliphatic substituents contains from about 8 to 18 carbon atoms and at least one aliphatic substituent contains an anionic water-solubilizing group.

Zwitterionic surfactants include derivatives of aliphatic, quaternary, ammonium, phosphonium, and sulfonium compounds in which one of the aliphatic substituents contains from about 8 to 18 carbon atoms.

Cationic surfactants can also be included in the present detergent granules. Cationic surfactants comprise a wide variety of compounds characterized by one or more organic hydrophobic groups in the cation and generally by a quaternary nitrogen associated with an acid radical. Pentavalent nitrogen ring compounds are also considered quaternary nitrogen compounds. Halides, methyl sulfate and hydroxide are suitable. Tertiary amines can have characteristics similar to cationic surfactants at washing solution pH values less than about 8.5. A more complete disclosure of these and other cationic surfactants useful herein can be found in U.S. Pat. No. 4,228,044, Cambre, issued Oct. 14, 1980, incorporated herein by reference.

Cationic surfactants are often used in detergent compositions to provide fabric softening and/or antistatic benefits. Antistatic agents which provide some softening benefit and which are preferred herein are the quaternary ammonium salts described in U.S. Pat. No. 3,936,537, Baskerville, Jr. et al., issued Feb. 3, 1976, which is incorporated herein by reference.

Useful cationic surfactants also include those described in U.S. Pat. No. 4,222,905, Cockrell, issued Sep. 16, 1980, and in U.S. Pat. No. 4,239,659, Murphy, issued Dec. 16, 1980, both incorporated herein by reference.

B. Sodium Carbonate

The compositions of the present invention also contain from about 5 to 99.95 weight %, preferably from about 5 to 75 weight %, more preferably from about 7 to 50 weight %, most preferably from about 10 to 40 weight %, of admixed sodium carbonate. Sodium carbonate ($Na_2CO_3$) can easily be obtained commercially. As described above, without the addition of hydrophobic amorphous silicate, such compositions ordinarily have solubility problems under laundering conditions such as when added to the washing machine tub in a pile, particularly when "reverse" order of addition is used and/or cold water is used.

C. Hydrophobic Amorphous Silicate Material

The compositions of the invention also contain from about 0.05 to 5 weight %, preferably from about 0.1 to 5 weight %, more preferably from about 0.2 to 2 weight %, most preferably from about 0.3 to 1 weight %, of hydrophobic amorphous silicate material. Such materials are extremely fine-particle size silicon dioxides, the surfaces of which have been chemically modified to make them predominantly hydrophobic. These materials may be fumed or precipitated. Individual particles have a diameter typically ranging from about 5 to about 100, preferably about 10 to 40, nanometers. However, the precipitated particles usually appear in the form of agglomerates having an average diameter of from about 1 to 100, preferably about 2 to 40, microns.

Hydrophobic amorphous silicate materials useful herein are commercially available from Degussa Corporation under the names Aerosil® and Sipernat®. These materials are described in Degussa Technical Bulletin Pigments No. 11, issued Oct. 1982, No. 6, issued Aug. 1986, and No. 32, issued Apr. 1980, and a bulletin entitled Precipitated Silicas and Silicates, issued Jul. 1984, all incorporated herein by reference. Examples of suitable materials include Sipernato® D10, D11 and D17, Quso® WR55 and WR83, and Aerosil® R972, R974, R805, and R202. Preferred materials are Aerosil® R972 and Sipernat® D11, which is particularly preferred.

In order to provide sufficient hydrophobic amorphous silicate material to improve the solubility of granular compositions containing admixed sodium carbonate, the weight ratio of admixed sodium carbonate to admixed hydrophobic amorphous silicate material should be from about 5:1 to about 500:1, preferably from about 5:1 to about 200:1, more preferably from about 10:1 to about 100:1, and most preferably about 20:1 to about 50:1.

Although the hydrophobic amorphous silicate material and the sodium carbonate can be admixed in any order to the compositions of the present invention, it is preferred that the hydrophobic amorphous silicate be premixed with the sodium carbonate before being admixed into the composition. Such premixing apparently allows for more efficient coating of the silicate material onto the carbonate, which results in improved physical properties at equal silicate levels or comparable properties at lower levels.

D. Other Ingredients

Other ingredients suitable for inclusion in a granular laundry detergent, bleach or additive composition can be added to the present compositions. These include detergency builders, bleaches, bleach activators, suds boosters or suds suppressors, anti-tarnish and anticorrosion agents, soil suspending agents, soil release agents, germicides, pH adjusting agents, non-builder alkalinity sources, chelating agents, smectite clays, enzymes, enzyme-stabilizing agents and perfumes. Such ingredients are described in U.S. Pat. No. 3,936,537, issued Feb. 3, 1976 to Baskerville, Jr. et al., incorporated herein by reference.

Builders (other than the required sodium carbonate) can be employed to sequester hardness ions and to help adjust the pH of the laundering liquor. Such builders can be employed in concentrations up to about 85% by weight, preferably from about 5% to about 50% by weight, most preferably from about 10% to about 30% by weight, of the compositions herein to provide their builder and ph-controlling functions. The builders herein include any of the conventional inorganic and organic water-soluble builder salts.

Such builders can be, for example, water-soluble salts of phosphates including tripolyphosphates, pyrophosphates, ortho-phosphates, higher polyphosphates, other carbonates, silicates, and organic polycarboxylates. Specific preferred examples of inorganic phosphate builders include sodium and potassium tripolyphosphates and pyrophosphates.

Nonphosphorus-containing materials can also be selected for use herein as builders.

Specific examples of nonphosphorus, inorganic detergent builder ingredients include water-soluble bicarbonate, and silicate salts. The alkali metal, e.g., sodium and potassium, bicarbonates, and silicates are particularly useful herein.

Aluminosilicate ion exchange materials useful in the practice of this invention are commercially available. The aluminosilicates useful in this invention can be crystalline or amorphous in structure and can be naturally-occurring aluminosilicates or synthetically derived. A method for producing aluminosilicate ion exchange materials is discussed in U.S. Pat. No. 3,985,669, Krummel et al, issued Oct. 12, 1976, incorporated herein by reference. Preferred synthetic crystalline aluminosilicate ion exchange materials useful herein are available under the designations Zeolite A, Zeolite B, and Zeolite X. In an especially preferred embodiment, the crystalline aluminosilicate ion exchange material in Zeolite A and has the formula $$Na_{12}[AlO_2)_{12}\cdot(SiO_2)_{12}].xH_2O$$

wherein x is from about 20 to about 30, especially about 27.

Water-soluble, organic builders are also useful herein. For example, the alkali metal, polycarboxylates are useful in the present compositions. Specific examples of the polycarboxylate builder salts include sodium and potassium, salts of ethylenediaminetetraacetic acid, nitrilotriacetic acid, oxydisuccinic acid, mellitic acid, benzene polycarboxylic acid, polyacrylic acid, and polymaleic acid.

Other desirable polycarboxylate builders are the builders set forth in U.S. Pat. No. 3,308,067, Diehl, incorporated herein by reference. Examples of such materials include the water-soluble salts of homo- and copolymers of aliphatic carboxylic acids such as maleic acid, itaconic acid, mesaconic acid, fumaric acid, aconitic acid, citraconic acid, and methylenemalonic acid.

Other suitable polymeric polycarboxylates are the polyacetal carboxylates described in U.S. Pat. No. 4,144,226, issued Mar. 13, 1979 to Crutchfield et al, and U.S. Pat. No. 4,246,495, issued Mar. 27, 1979 to Crutchfield et al, both incorporated herein by reference. These polyacetal carboxylates can be prepared by bringing together under polymerization conditions an ester of glyoxylic acid and a polymerization initiator. The resulting polyacetal carboxylate ester is then attached to chemically stable end groups to stabilize the polyacetal carboxylate against rapid depolymerization in alkaline solution, converted to the corresponding salt, and added to a surfactant.

The compositions herein preferably contain little (e.g., less than 10%, preferably less than 5%, by weight) or no phosphate builder materials. The presence of higher levels of tripolyphosphate improves solubility of the compositions to the point where hydrophobic amorphous silicate provides little or no additional improvements. However, sodium pyrophosphate reduces solubility so that the benefit provided by the hydrophobic amorphous silicate is greater in granular compositions containing pyrophosphate.

Bleaching agents and activators useful herein are also described in U.S. Pat. No. 4,412,934, Chung et al., issued Nov. 1, 1983, U.S. Pat. No. 4,483,781, Hartman, issued Nov. 20, 1984, U.S. Pat. No. 4,634,551, Burns et al, issued Jan. 6, 1987, and U.S. Pat. No. 4,909,953, Sadlowski et al, issued Mar. 20, 1990, all of which are incorporated herein by reference. Chelating agents are also described in U.S. Pat. No. 4,663,071, Bush et al., from Column 17, line 54 through Column 18, line 68, incorporated herein by reference. Suds modifiers are also optional ingredients and are described in U.S. Pat. Nos. 3,933,672, issued Jan. 20, 1976 to Bartoletta et al., and 4,136,045, issued Jan. 23, 1979 to Gault et al., both incorporated herein by reference.

Suitable smectite clays for use herein are described in U.S. Pat. No. 4,762,645, Tucker et al, issued Aug. 9, 1988, Column 6, line 3 through Column 7, line 24, incorporated herein by reference. Suitable additional detergency builders for use herein are enumerated in the Baskerville patent, Column 13, line 54 through Column 16, line 16, and in U.S. Pat. No. 4,663,071, Bush et al, issued May 5, 1987, both incorporated herein by reference.

Particularly preferred low or no phosphate compositions herein are granular laundry detergents comprising by weight:

(a) from about 10% to about 30% of a mixture of a $C_{11}$–$C_{13}$ alkylbenzene sulfonate surfactant and a $C_{12}$–$C_{16}$ (preferably $C_{14}$–$C_{16}$) alkyl sulfate surfactant in a weight ratio of sulfonate surfactant to sulfate surfactant of from about 4:1 to about 1:4 (preferably about 3:1 to about 1:3);

(b) from 0% to about 3% of an alkali metal (preferably sodium) silicate having a molar ratio Of $SiO_2$ to alkali metal oxide of from about 1.0 to about 2.4;

(c) from about 10% to about 50% (preferably about 15% to about 30%) of a finely divided aluminosilicate ion exchange material selected from the group consisting of:

(i) crystalline aluminosilicate material of the formula:

$$Na_z[(AlO_2)_z.(SiO_2)y].xH_2O$$

wherein z and y are at least 6, the molar ratio of z to y is from 1.0 to 0.5 and x is from 10 to 264, said material having a particle size diameter of from about 0.1 micron to about 10 microns, a calcium ion exchange capacity of at least about 200 mg $CaCO_3$eq./g and a calcium ion exchange rate of at least about 2 grains Ca++/gallon/minute/gram/gallon;

(ii) amorphous hydrated aluminosilicate material of the empirical formula:

$$M_z(zAlO_2.YSiO_2)$$

wherein M is sodium, potassium, ammonium, or substituted ammonium, z is from about 0.5 to about 2 and y is 1, said material having a magnesium ion exchange ion exchange capacity of at least about 50 milligram equivalents of $CaCO_3$ hardness per gram of anhydrous aluminosilicate and a Mg++exchange rate of at least about 1 grain/gallon/minute/gram/gallon; and (iii) mixtures thereof;

(d) from about 7% to about 50% of admixed sodium carbonate;

(e) from about 0.2% to about 2% of admixed hydrophobic amorphous silicate material; wherein the weight ratio of (d):(e) is from about 10:1 to about 100:1.

Preferred aluminosilicate ion exchange material is of the formula $Na_{12}[(AlO_2)_{12}(SiO_2)_{12}].xH_2O$, wherein x is from about 20 to about 30.

E. Process

Also included in the present invention is a process for improving solubility or dispersibility of a granular laundry detergent, bleach or additive composition as described above. The process comprises:

(a) admixing sodium carbonate and hydrophobic amorphous silicate material;

wherein the final composition comprises from about 5 to 99.95 weight % of admixed sodium carbonate, and from about 0.05 to about 5 weight % of admixed hydrophobic amorphous silicate material, in a weight ratio of admixed sodium carbonate to admixed hydrophobic amorphous silicate of from about 5:1 to about 500:1. The process results in a two-component detergent product which can be used as an additive.

Preferably, the process comprises:

(a) producing granules comprising from 0 to 70 weight % detergent surfactant selected from the group consisting of anionics, nonionics, zwitterionics, ampholytics, cationics, and mixtures thereof; and (b) admixing with said granules sodium carbonate and hydrophobic amorphous silicate material;

wherein the final composition comprises from 0 to about 70 weight % of the detergent surfactant, from about 5 to 99.95 weight %, preferably from about 5 to 75 weight % of admixed sodium carbonate, and from about 0.05 to 5 weight %, preferably from about 0.1 to 5 weight % of admixed hydrophobic amorphous silicate material, in a weight ratio of admixed sodium carbonate to admixed hydrophobic amorphous silicate of from about 5:1 to about 500:1, preferably from about 5:1 to about 200:1.

Preferred compositions for use in the process are as described above.

The following examples illustrate the compositions and processes of the present invention. All parts, percentages, and ratios herein are by weight unless otherwise specified.

EXAMPLE I

Granular compositions of the present invention comprise the following ingredients at the indicated levels.

| Ingredient | Percent (Wt) | | | | |
|---|---|---|---|---|---|
| | I | II | III | IV | V |
| Sodium 12.3 linear alkyl benzene sulfonate | 13.16 | 10.64 | 14.43 | — | — |
| Sodium $C_{14}$–$C_{15}$ alkyl sulfate | 5.64 | 4.56 | 6.18 | — | — |
| $C_{12}$–$C_{13}$ alcohol polyethoxylate (6.5 EO) | — | — | — | 0.63 | — |
| Sodium tripoly-phosphate | — | — | 7.27 | — | — |
| Sodium pyrophosphate | — | — | 29.07 | — | — |
| Zeolite A, hydrate (1–10 micron size) | 26.30 | 21.30 | — | — | — |
| Sodium carbonate - total | 23.60 | 26.17 | 12.37 | 39.29 | 99.25 |
| (Sodium carbonate admixed) | (14.13 | 18.88 | 12.37 | 39.29) | (99.25) |
| Sodium silicate (1.6 ratio $NaO/SiO_2$) | 2.29 | 2.86 | 8.00 | 6.57 | — |
| Pentasodium diethylene-triamine pentaacetate | — | 0.43 | — | 0.83 | — |
| Polyethylene glycol 8000 | 1.73 | 1.44 | 0.61 | — | — |
| Sodium polyacrylate (MW 4500) | 3.39 | 2.72 | 1.52 | — | — |
| Protease enzyme* | 1.09 | 0.75 | 0.84 | 0.41 | — |
| Sodium perborate monohydrate | 0.82 | 4.21 | 0.41 | 14.42 | — |
| Nonanoyloxy-benzene sulfonate | — | 6.00 | — | 21.21 | — |
| Sodium sulfate | 10.33 | 8.28 | 11.41 | 15.88 | — |
| Sipernat ® D11 | 0.44 | 0.44 | 0.50 | 0.30 | 0.75 |
| Blance (including water, brightener, perfume, suds suppressor) | | | to 100.0 | | |

*Activity of 1.8 Anson units per gram.

The composition of Examples I–III are prepared by spray drying aqueous crutcher mixes of the above ingredients, except for the enzyme, perfume, perborate, nonanoyloxybenzene sulfonate, and a premix of the Sipernat ® D11 and the sodium carbonate indicated as admixed, all of which are admixed. The compsoition of Example V is prepared by admixing the sodium carbonate and the Sipernat ® D11. Composition IV is a granular bleach composition prepared by dry mixing the ingredients.

After washing clothes using the above compositions, little or no insoluble clumps remain on the clothes or in the washing machine tub, even when a "reverse" order of addition and cold wash water are used. Such compositions thus demonstrate better solubility than similar compositions not containing Sipernate ® D11.

What is claimed is:

1. A granular laundry detergent, bleach or additive composition comprising, by weight:

(a) from 0 to 70 weight % detergent surfactant selected from the group consisting of anionics, nonionics, zwitterionics, ampholytics, cationics, and mixtures thereof;

(b) from about 5 to 99.95% of admixed sodium carbonate; and (c) from about 0.05% to 5% of admixed hydrophobic amorphous silicate material;

wherein the weight ratio of (b):(c) is from about 5:1 to about 500:1.

2. A granular laundry composition according to claim 1, comprising from about 5 to 50 weight % detergent surfactant selected from the group consisting of anionics, nonionics, and mixtures thereof.

3. A granular laundry composition according to claim 2 wherein the detergent surfactant comprises a mixture of $C_{11}$–$C_{13}$ linear alkylbenzene sulfonate and $C_{14}$–$C_{16}$ alkyl sulfate surfactants.

4. A granular laundry composition according to claim 3 comprising from about 10 to 25 weight % of a mixture of the alkylbenzene sulfonate and alkyl sulfate surfactants in a weight ratio of from about 1:4 to about 4:1.

5. A granular laundry composition according to claim 2 comprising from about 10 to 40 weight % admixed sodium carbonate.

6. A granular laundry composition according to claim 5 comprising from about 0.2 to 2 weight % admixed hydrophobic amorphous silicate material.

7. A granular laundry composition according to claim 6 comprising from about 10 to 25 weight % of a mixture of $C_{11}$–$C_{13}$ linear alkylbenzene sulfonate and $C_{14}$–$C_{16}$ alkyl sulfate surfactants.

8. A granular laundry composition according to claim 1 further comprising from about 10% to about 50% by weight of an aluminosilicate ion exchange material of the formula $$Na_{12}[(AlO_2)_{12}(SiO_2)_{12}].xH_2O,$$

wherein x is from about 20 to about 30.

9. A granular laundry composition according to claim 8 which is substantially free of phosphate builder material.

10. A granular laundry detergent composition according to claim 9 comprising, by weight:

(a) from about 10 to 25 weight % sodium $C_{11-13}$ linear alkylbenzene sulfonate and sodium $C_{14-16}$ alkyl sulfate in a ratio between 3:1 and 1:3;

(b) from about 10 to 40% admixed sodium carbonate;

(c) from about 0.2 to 2% admixed hydrophobic amorphous silicate material; and (d) from about 15% to about 30% of aluminosilicate ion exchange material of the formula $$Nahd\ 12[(AlO_2)_{12}(SiO_2)_{12}.xH_2O,$$

wherein x is from about 20 to about 30.

11. A process for improving solubility or dispersibility of a granular laundry detergent, bleach or additive composition which comprises:

(a) producing granules comprising from 0 to 70 weight % detergent surfactant selected from the group consisting of anionics, nonionics, zwitterionics, ampholytics, cationics, and mixtures thereof; and (b) admixing sodium carbonate and hydrophobic amorphous silicate material with said granules;

wherein the resulting composition comprises from 0 to about 70 weight % detergent surfactant, from about 5 to 99.95 weight % sodium carbonate, and from about 0.05 to 5 weight % hydrophobic amorphous silicate material, and the weight ratio of admixed sodium carbonate to admixed hydrophobic amorphous silicate is from about 5:1 to about 500:1.

12. A process for improving solubility or dispersibility of a granular laundry composition according to claim 11 wherein the resulting detergent composition comprises from about 10 to 25 weight % sodium linear $C_{11-13}$ alkylbenzene sulfonate and sodium $C_{14-16}$ alkyl sulfate, from about 10 to 40 weight % of admixed sodium carbonate, and from about 0.3 to 1 weight % of admixed hydrophobic amorphous silicate material.

13. A process for improving solubility or dispersibility of a granular laundry composition according to claim 12, which composition further comprises from about 15% to about 30% by weight of an aluminosilicate ion exchange material of the formula $$Na_{12}[(AlO_2)_{12}(SiO_2)_{12}.xH_2O,$$

wherein x is from about 20 to about 30.

* * * * *